United States Patent [19]

Kawabata et al.

[11] 4,364,301

[45] Dec. 21, 1982

[54] VACUUM ACTUATOR

[75] Inventors: Yasuhiro Kawabata, Anjo; Kongo Aoki, Kariya, both of Japan

[73] Assignee: Aisin Seiki Kabushiki Kaisha, Japan

[21] Appl. No.: 186,160

[22] Filed: Sep. 11, 1980

[30] Foreign Application Priority Data

Sep. 21, 1979 [JP] Japan ..... 54-122360

[51] Int. Cl.[3] ..... F15B 15/22

[52] U.S. Cl. ..... 91/20; 91/395; 91/398; 91/408

[58] Field of Search ..... 91/357, 395, 408, 409, 91/407, 20, 398; 92/100

[56] References Cited

U.S. PATENT DOCUMENTS

| | | | |
|---|---|---|---|
| 3,072,108 | 1/1963 | Cripe | 91/357 |
| 3,381,582 | 5/1968 | Golden | 91/395 |
| 3,545,070 | 12/1970 | Bauer | 92/100 |
| 3,657,966 | 4/1972 | Campbell | 91/357 |

*Primary Examiner*—Paul E. Maslousky
*Attorney, Agent, or Firm*—Finnegan, Henderson, Farabow, Garrett & Dunner

[57] ABSTRACT

A vacuum actuator for connection to a vacuum source, the actuator utilizing a diaphragm combination having three stable positions. An annular diaphragm, having its outer periphery fixed in a housing, has its inner periphery secured between two movable annular members, the diaphragm and the annular members forming a combination dividing the housing into upper and lower chambers. Two inlet ports individually supply a vacuum force or atmospheric pressure to the upper chamber, the first one of the ports including a projection extending toward a space formed by the movable members. A poppet valve normally closes an opening at the top of the space, the bottom of the space normally having access to the atmosphere. When vacuum is applied to the first port, the diaphragm combination is raised from a biased first position to the position where the poppet valve interrupts the vacuum through the projection, determining the second position. The application of vacuum force to the second inlet port then raises the diaphragm combination to the third stable position, the projection sliding the poppet valve to a lower position in the space formed by the movable members, closing the access to the atmosphere.

6 Claims, 2 Drawing Figures

| | | | | |
|---|---|---|---|---|
| 1 ST. INLET | 14 | ATMOS. | VACUUM | BLIND |
| 2 ND. INLET | 15 | ATMOS. | BLIND | VACUUM |

VACUUM ACTUATOR

BACKGROUND OF THE INVENTION

This invention relates to vacuum actuators, and more particularly to a vacuum actuator equipped with a movable diaphragm member having three stable positions.

There have been proposed many vacuum actuators equipped with a movable diaphragm having three positions. However, most of them have difficulties especially in positioning the diaphragm at the intermediate position.

SUMMARY OF THE INVENTION

It is, therefore, an object of the invention to provide an improved vacuum actuator which obviates the above conventional drawbacks.

It is another object of the invention to provide a vacuum actuator which includes a diaphragm member movable to three stable positions in response to the vacuum pressure introduced therein through two separate vacuum inlet ports.

DETAILED DESCRIPTION OF THE INVENTION

Figure 1:
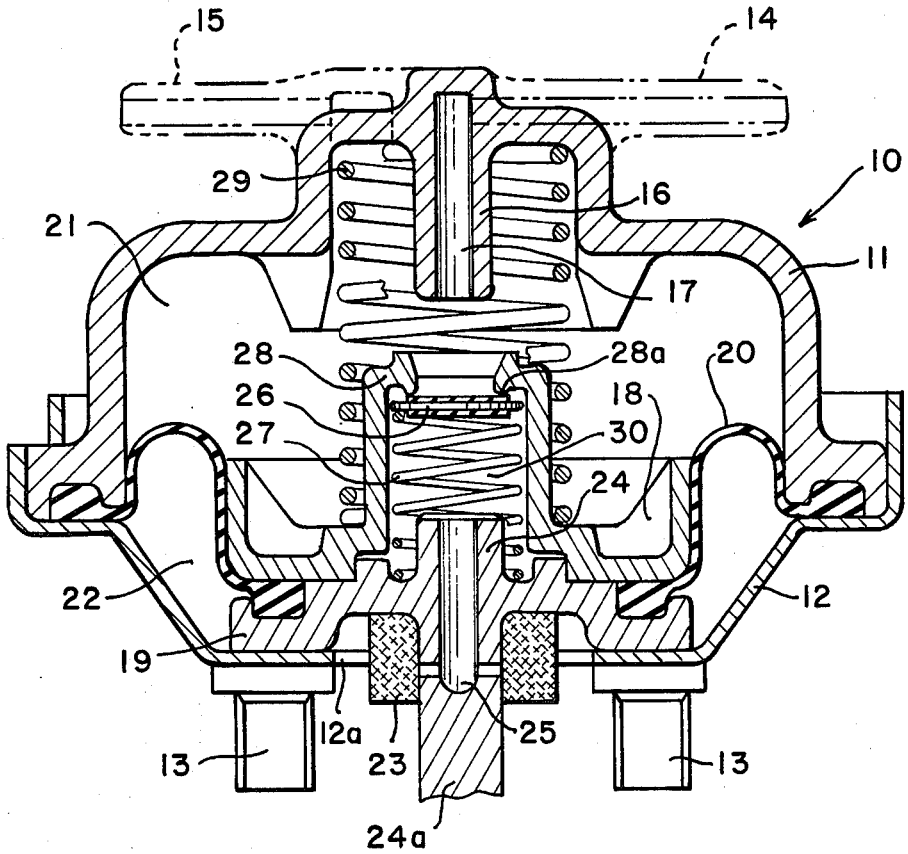
FIG. 1 is a cross-sectional view of the vacuum actuator of our invention.

Referring now to the attached drawings, numeral 10 generally indicates a vacuum actuator utilized, for example, in an automobile air conditioner. The actuator 10 has upper and lower housings 11 and 12 secured to each other. The lower housing 12 has several threaded portions 13 through which the actuator 10 may be secured, for example, to a stationary portion of a vehicle (not shown).

Upper housing 11 has first and second inlet ports 14 and 15, each being communicable with an engine intake manifold (not shown) as a vacuum source.

A vertically downward extending annular projection 16 is formed in the upper housing 11 and has a passage 17 therein which communicates with the first inlet port 14.

An annular diaphragm member 20 is at its outer periphery sealing by secured between the upper and lower housings 11 and 12 to divide the actuator 10 into upper and lower compartments 21 and 22.

The projection 16 terminates in the upper compartment 21 and the inlet port 15 communicates directly with the upper compartment.

The inner periphery of the annular diaphragm member 20 is secured between upper and lower movable members 18 and 19 which are vertically movable within the actuator 10 with the diaphragm member 20. The lower movable member 19 is formed with an upstanding vertical annular projection 24 which has passages 25 therein to introduce atmospheric pressure through an air filter 23 attached to the lower movable member into a space 30 formed between the vertical projection 24 and an annular flange portion 28 formed on the first movable member 18. The upper portion of the flange portion 28 forms an opening for receiving the annular projection 16 when the diaphragm 20 moves upwardly.

The lower compartment 22, formed between the lower housing 12, the diaphragm member 20 and the second movable member 19, is always exposed to atmospheric pressure through an opening **12*a* formed in the lower housing 12**.

A poppet valve 26 is disposed in the space 30 between the two movable members 18 and 19 and is continuously biased upwardly by a spring 27 to be normally in sealing contact with a valve seat surface **28*a* formed by a shoulder on the lower side of the opening in the annular flange 28 of the first movable member 18. If the poppet valve 26 is forced downwardly through the space 30 to its lowermost position against the bias of the spring 27, it seals the outlet of the passages 25 conveying atmospheric pressure to the space 30**.

A spring 29 is disposed between the first movable member 18 and the upper housing 11 to continuously bias the diaphragm member 20 downwardly.

A downwardly extending portion **24*a* of the second movable member 19, opposite the vertical projection 24** may be connected to an external device, such as, a damper of a vehicle air conditioner (not shown) or an engine throttle valve (not shown).

OPERATION

When both of the inlet ports 14 and 15 are exposed to atmospheric pressure, the diaphragm member 20 with the two attached movable members 18 and 19, is biased downwardly by the spring 29 to the first position against the lower housing 12, as shown in FIG. 1.

However, when the first inlet port 14 is connected to a vacuum source, such as an engine intake manifold, while the second inlet port 15 is closed to both vacuum and atmospheric pressure, the diaphragm member 20 will be drawn inwardly overcoming the force of spring 29 due to the pressure differential between the upper and lower compartments 21 and 22.

When the annular flange 28 of the first movable member 18 moves upwardly and the vertical projection 16 of the upper housing 11 contacts the upper surface of the poppet valve 26 through the flange opening, the communication between the upper compartment 21 and the vacuum passage 17 of the projection 16 is interrupted. The upward movement of the diaphragm member 20 is thus stopped and the diaphragm member 20 is kept at its second position.

If the contact between the upper surface of the poppet valve 26 and the projection 16 of the upper housing 11 is not airtight, then the vacuum through the passage 17 will be further introduced into the upper compartment 21 through the first inlet port 14 thereby moving the diaphragm farther upwardly so as to seal the contact between the projection 16 and the poppet valve to stabilize the position of the diaphragm.

On the other hand, if the projection 16 extends a little too far and forces the poppet valve 26 to be separated from the seat **28*a*, atmospheric pressure in the space 30 is introduced into the upper compartment 21 and the diaphragm member 20 moves downwardly allowing the spring 27** to reseat the poppet valve against the valve seat. The intermediate position of the diaphragm is thus also stabilized.

If, in this condition, the second inlet port 15 is connected to the vacuum source, the vacuum in the upper compartment 21 increases so as to make a further pressure differential with the lower compartment 22. Then the diaphragm member 20 again moves upwardly and the poppet valve 26 is forced downwardly by the projection 16 until the under surface of the valve 26 contacts the projection 24 of the second movable member 19.

Under such conditions, although the poppet valve 26 is separated from the seat 28*a* of the flange 28, the passages 25 and communication with the atmosphere are interrupted by the contact of the lower surface of the valve 26 with the projection 24. Thus the third stable position of the diaphragm member 20 is determined.

Figure 2:
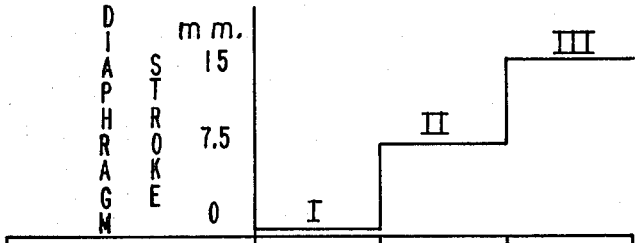
FIG. 2 is an operational diagram of the diaphragm of the actuator of FIG. 1.

As shown in the diagram of FIG. 2, both the inlet ports 14,15 are at atmospheric pressure at the first position of the diaphragm, designated I on the diagram. At the second position II of the diaphragm, inlet port 14 is under vacuum and the inlet port 15 is blind. At the third position III of the diaphragm, the inlet port 15 is under vacuum but the inlet port 14 is blind, being shut off by upper surface of the poppet valve 26. Illustratively, the stroke of the diaphragm is shown as 7.5 mm between positions.

What is claimed is:

1. A vacuum actuator for connection to a vacuum source, said actuator comprising:

a housing:

annular diaphragm means dividing the interior of the housing into first and second fluid chambers, said diaphragm means being biased into a first stable position wherein a portion of the diaphragm means abuts the housing;

first and second inlet ports formed in said first chamber for individual communication either with the vacuum source or with atmospheric pressure;

passage means independent of said first and second ports for continuously communicating atmospheric pressure to said second fluid chamber;

poppet valve means for terminating communication between said first inlet port and said first fluid chamber in response to upward movement of said diaphragm means and for controlling communication of atmospheric pressure to said first fluid chamber from said second fluid chamber;

said diaphragm means being stabilized in said first position when both inlet ports communicate with atmospheric pressure, in a second position when said first inlet port communicates with said vacuum source, said second inlet port is disconnected from fluid communication with said first fluid chamber and said poppet valve closes fluid communication between said first inlet port and said first fluid chamber, and in a third position when fluid communication between said first inlet port and said first fluid chamber continues to be terminated, vacuum is applied to said second inlet port, and said poppet valve means closes off communication of atmospheric pressure between said second fluid chamber and said first fluid chamber in response to maximum upward movement of said diaphragm means, said poppet valve means admitting atmospheric pressure to said first fluid chamber from said second fluid chamber between said second and third stable positions of said diaphragm means.

2. A vacuum actuator as set forth in claim 1 wherein said annular diaphragm means includes an annular diaphragm member, first and second movable members secured to each other for locking the inner edge of the annular diaphragm member therebetween, and wherein a space is formed between said first and second movable members.

3. A vacuum actuator as set forth in claim 2 wherein said poppet valve means is positioned in said space.

4. A vacuum actuator as set forth in claim 2 wherein said space is encompassed by an annular flange formed on said first movable member, said flange including an inner shoulder, said poppet valve being normally seated against said shoulder, and wherein said first inlet port includes a downwardly extending annular projection for contacting said poppet valve in said annular flange in the second stable position of said diaphragm means and during further upward motion of said diaphragm means.

5. A vacuum actuator as set forth in claim 3 wherein a channel is provided in said second movable member for normally transmitting air into said space from said second fluid chamber, and wherein said poppet valve closes said channel in the third stable position of the diaphragm.

6. A vacuum actuator as set forth in claim 5, wherein said poppet valve is slidable in said space between an upper position sealed against said shoulder and a lower position closing said channel, and wherein said poppet valve is moved downwardly by said projection during the upward movement of said diaphragm means from the second to the third position.

* * * * *